US006336330B1

(12) United States Patent
Girbig

(10) Patent No.: US 6,336,330 B1
(45) Date of Patent: Jan. 8, 2002

(54) STEAM-TURBINE PLANT

(75) Inventor: Paul Girbig, Uttenreuth (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/658,710

(22) Filed: Sep. 11, 2000

Related U.S. Application Data

(63) Continuation of application No. PCT/DE99/00603, filed on Mar. 5, 1999.

(30) Foreign Application Priority Data

Mar. 11, 1998 (DE) ..... 198 10 580

(51) Int. Cl.[7] ..... F01K 1/00
(52) U.S. Cl. ..... 60/670; 251/208; 251/304
(58) Field of Search ..... 60/670; 251/208, 251/304

(56) References Cited

U.S. PATENT DOCUMENTS 3,602,261 A * 8/1971 Brown ..... 137/625.3
4,040,600 A * 8/1977 Coppola et al. ..... 251/63
4,103,592 A * 8/1978 Davis ..... 91/448
4,881,718 A 11/1989 Champagne
6,070,605 A * 6/2000 Steenburgh ..... 137/1

FOREIGN PATENT DOCUMENTS

| | | |
|---|---|---|
| CH | 436345 | 11/1967 |
| DE | 158534 | 4/1903 |
| DE | 582436 | 7/1933 |
| DE | 1773770 | 9/1958 |
| DE | 2350263 | 4/1975 |
| FR | 341546 | 8/1904 |
| FR | 1542987 | 10/1968 |

* cited by examiner

*Primary Examiner*—Hoang Nguyen
(74) *Attorney, Agent, or Firm*—Herbert L. Lerner; Laurence A. Greenberg; Werner H. Stemer

(57) ABSTRACT

The flow of steam into a steam-collecting space of a steam turbine is controlled with a steam-inlet valve. The novel steam-inlet valve has an especially high control performance and losses of steam are kept especially low. The steam-inlet valve has a rotary cylinder that forms a shut-off member. The rotary cylinder is placed in a housing, and a steam inlet can be connected to a steam outlet via a passage provided in the peripheral surface of the rotary cylinder.

13 Claims, 4 Drawing Sheets

STEAM-TURBINE PLANT

CROSS-REFERENCE TO RELATED APPLICATION

This is a continuation of copending international application PCT/DE99/00603, filed Mar. 5, 1999, which designated the United States.

BACKGROUND OF THE INVENTION

Field of the Invention

The invention relates to a steam-turbine plant, wherein a steam-collecting space is arranged upstream of its steam turbine and a steam-inlet valve is provided for controlling the introduction of steam into the steam-collecting space.

Steam-turbine plants are generally used for generating electrical energy or even for driving a machine. A working medium, normally a water-water/steam mixture, which is directed in an evaporator circuit of the steam-turbine plant, is evaporated in an evaporator. The steam generated in the process expands to perform work in the steam turbine and is then fed to a condenser or a machine. The working medium condensed in the condenser is then fed back to the evaporator via a feedwater pump.

In steam-turbine plants, control valves designated as nozzle-group control serve to control the introduction of steam into a steam-collecting space. The control valves are normally opened and closed by a spindle system or by a hydraulic drive. In the case of a spindle system, the control valves are hung in a beam which is arranged in the steam-collecting space and can be moved by two spindles. Alternatively, the control valves may have hydraulic individual units. The hydraulic individual units normally actuate the individual control valves via a linkage.

Such control valves require especially high actuating forces, since they have to be closed counter to the direction of the steam flow. High actuating forces in turn slow down the actuating speed of the control valves and thus have an adverse effect on the control performance of the control valves. In addition, the spindles of the spindle system or of the linkage of the hydraulic system are normally passed in each case through a stuffing box through the casing of the steam-collecting space. Since the respective nozzle-group control is actuated through the corresponding stuffing boxes, losses of steam cannot be avoided in the process. Such losses may turn out to be especially high where there are a plurality of stuffing boxes.

SUMMARY OF THE INVENTION

The object of the invention is to provide a steam turbine plant which overcomes the above-noted deficiencies and disadvantages of the prior art devices and methods of this kind, which has a steam-inlet valve that permits an especially high control performance and in which steam losses turn out to be especially low.

With the above and other objects in view there is provided, in accordance with the invention, a steam-turbine plant, comprising:

- a steam turbine and a steam-collecting space with an inlet side upstream of the steam turbine;
- a steam-inlet valve disposed to control a flow of steam into the steam-collecting space at the inlet side;
- the steam-inlet valve having a housing formed with a steam inlet and a steam outlet, and a rotary cylinder disposed in the housing and forming a shut-off member, the rotary cylinder being formed with a passage enabling a connection between the steam inlet and the steam outlet.

In other words, the objects of the invention are achieved in that the steam-inlet valve of the steam-turbine plant has a rotary cylinder arranged as a shut-off member in a housing.

The steam inlet provided in the housing can be connected to a steam outlet provided in the housing via a passage arranged in the rotary cylinder.

The invention is based on the idea that an especially high control performance can be achieved for a steam-inlet valve of a steam-turbine plant by this steam-inlet valve being designed for especially low actuating forces. Especially low actuating forces are possible if the steam-inlet valve is designed in such a way that actuating movements in a direction along the direction of the steam flow are largely avoided. This can be achieved in an especially simple manner by the steam-inlet valve being designed not for linear actuating movements but for rotational actuating movements. To this end, a rotary cylinder is provided as a shut-off member of the steam-inlet valve. In such an arrangement, the number of requisite seals is also especially small. The steam-inlet valve therefore has especially low losses of steam.

In accordance with an added feature of the invention, the rotary cylinder has a peripheral surface and the passage of the steam-inlet valve extends along the peripheral surface of the rotary cylinder, i.e., the passage is run on the surface of the rotary cylinder. This is because a steam-inlet valve of such a design can be adapted to various requirements in an especially flexible manner. For example, the steam inlet can be connected to the steam outlet even in different positions of the rotary cylinder if a suitable length of the passage is selected.

In order to additionally keep the risk of steam loss especially low, the housing enclosing the rotary cylinder is advantageously made in one piece. The rotary cylinder is thereby inserted into the housing via a single access opening, which is sealed off from the surroundings via an end plate arranged on-the free end of the rotary cylinder.

The end plate of the steam-inlet valve is advantageously designed in such a way that it has a crenellated profile, in cross section, on its side facing the housing of the rotary cylinder. Steam escaping at the sealing point must then cover an especially long distance to reach the surroundings, as a result of which the risk of undesirable steam escape is kept especially low.

That end of the rotary cylinder which is arranged inside the housing is advantageously mounted in a conical bearing element arranged in the housing of the rotary cylinder. This is because such a configuration permits especially simple assembly, since the conical bearing element results in automatic centering when the rotary cylinder is inserted.

The steam-inlet valve advantageously has a spring system which mechanically preloads the rotary cylinder. In this design, the steam-inlet valve is suitable for especially short quick-closing times and closes automatically in the event of a failure of the system controlling the rotary movement of the rotary cylinder.

Steam losses caused by an accident can thus be avoided.

Depending on the operating mode and the operating conditions, the steam to be introduced into the steam-collecting space may contain an especially high proportion of impurities. So that the steam-inlet valve is insensitive to such impurities, it advantageously has a rotary cylinder whose surface is made of a ceramic material. This is because a ceramic material has especially low adhesion for impurities in the steam and is also especially insensitive to excessive temperature changes.

In order to also ensure operating capability even in the case of especially low steam quality, a permanent high-frequency disturbance signal may be applied as actuating signal to the steam-inlet valve, and this disturbance signal ensures ease of motion of the valve.

The passage run in the surface of the rotary cylinder advantageously has a narrowing cross section. This is because different flow rates of the steam can then be set when the passage is appropriately positioned relative to the steam inlet and/or the steam outlet.

In accordance with another feature of the invention, the passage advantageously has an arc angle which is defined by a starting point and by an end point of the passage relative to the rotary-cylinder axis and is greater than 180°. In other words, the passage extends over more than half the circumference of the rotary cylinder. This is because an especially large number of combinations of a passage cross section with a steam inlet and/or steam outlet are possible in this design.

For special flexibility when setting the flow rate of the steam, the steam-inlet valve advantageously has a plurality of passages which are arranged on the surface of a common rotary cylinder. In this arrangement, a steam inlet can be connected in each case via a passage to a steam outlet assigned to it. In such an arrangement, given a suitable design of the rotary cylinder, it is possible to open one or more passages in a specific manner depending on the operating position of the rotary cylinder.

The arc angles of the passages are advantageously formed in such a way that steam can flow through a first passage in a first position of the rotary cylinder and steam can flow through the first passage and a second passage in a second position of the rotary cylinder. In this design, the steam-inlet valve permits gradual opening of the passages, as a result of which especially high flexibility during the feeding of steam into the steam-collecting space is possible.

The steam-inlet valve is advantageously connected to a steam-collecting space which is arranged upstream of a steam turbine of a steam-turbine plant. This is because the steam-inlet valve is especially suitable for this purpose on account of its especially high control performance and on account of the fact that there is an especially low risk of steam loss from this steam-inlet valve.

The advantages achieved with the invention consist in particular in the fact that, in the steam-turbine plant having the steam-inlet valve arranged upstream of a steam-collecting space, the risk of steam losses is kept especially low on account of the rotary cylinder provided as a shut-off member. In addition, the steam-inlet valve has especially low actuating forces, since it is designed for rotational actuating movements. As a result, the steam-inlet valve has an especially high actuating speed and thus an especially high control performance. In addition, the especially low actuating forces permit the use of an electrical control mechanism for the steam-inlet valve. It is therefore possible to dispense with a hydraulic actuating system, which on account of the hydraulic oils is always a potential source of fire in the steam-turbine plant.

Other features which are considered as characteristic for the invention are set forth in the appended claims.

Although the invention is illustrated and described herein as embodied in a steam-turbine plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Identical and functionally equivalent parts are identified with the same reference numerals throughout the figures.

DESCRIPTION OF THE PREFERRED EMBODIMENTS

Figure 1:
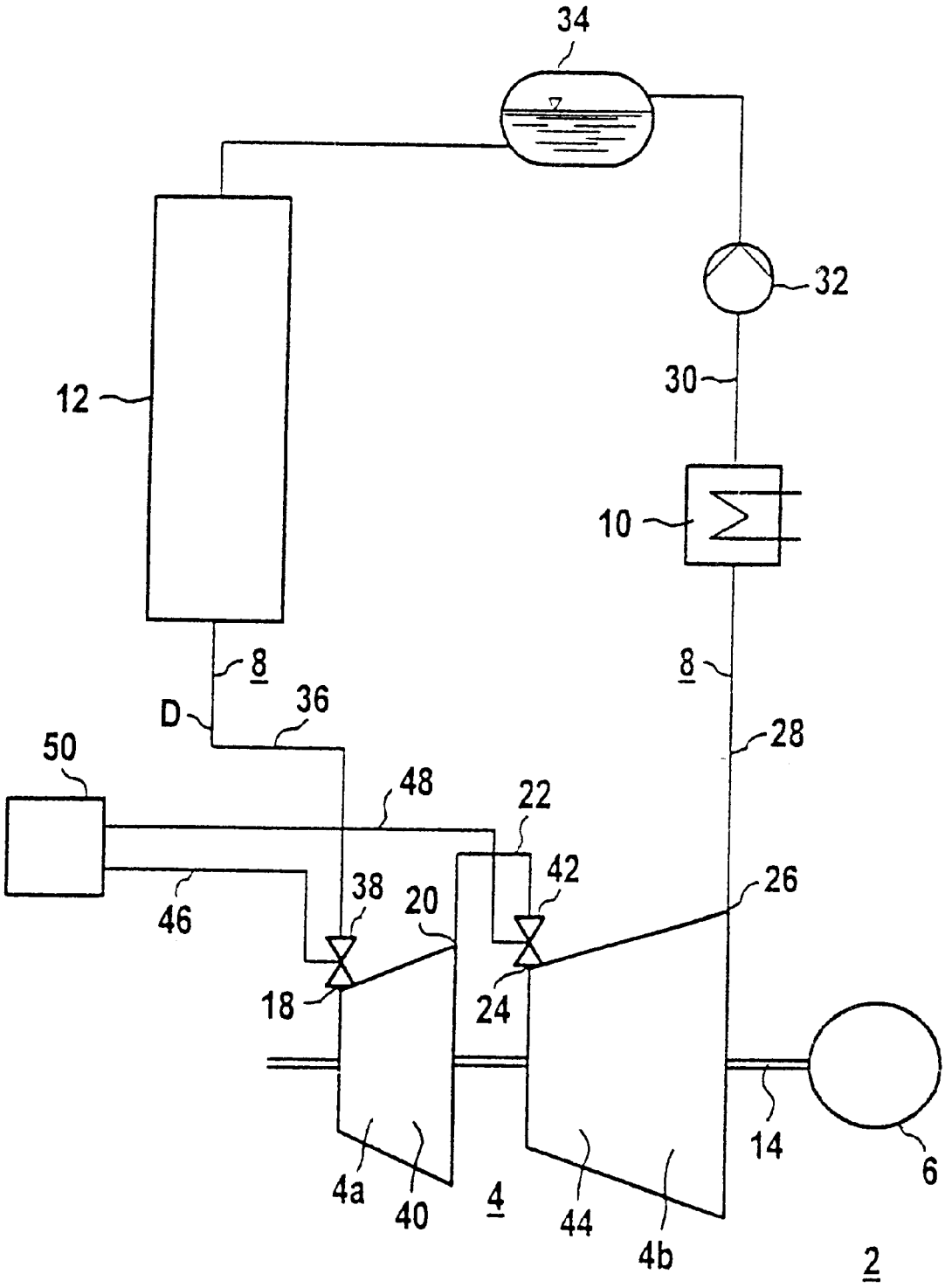
FIG. 1 is a schematic diagram of a steam-turbine plant with two steam-inlet valves for controlling the introduction of steam into the steam turbine.

Referring now to the figures of the drawing in detail and first, particularly, to FIG. 1 thereof, there is seen a steam-turbine plant 2 that has a steam turbine 4 with coupled generator 6 and, in a water/steam loop 8, a condenser 10 arranged downstream of the steam turbine 4. The plant further includes a steam generator 12. The steam turbine 4 has a first pressure stage or a high-pressure part 4a and a further stage or an intermediate- and low-pressure part 4*b*, which drive the generator 6 via a common shaft 14.

The steam generator 12 is connected on the steam-outlet side to the steam inlet 18 of the high-pressure part 4*a* of the steam turbine 4. A steam outlet 20 of the high-pressure part 4*a* of the steam turbine 4 is connected via an overflow line 22 to a steam inlet 24 of the intermediate- and low-pressure part 4*b* of the steam turbine 4. A steam outlet 26 of the intermediate- and low-pressure part 4*b* of the steam turbine 4 is connected via a steam line 28 to the condenser 10. The latter, via a feedwater line 30, in which a feedwater pump 32 and a feedwater tank 34 are connected, is connected to the steam generator 12 in such a way that a closed water/steam loop 8 is obtained.

The steam-turbine plant 2 is configured so that the introduction of steam D into the high-pressure part 4*a* and the intermediate- and low-pressure part 4*b* of the steam turbine 4 is controlled. To this end, the steam line 36 connecting the steam generator 12 and the steam turbine 4 opens into a steam-inlet valve 38 disposed on the inlet side upstream of the steam-collecting space 40. The latter is a casing of the turbine of the high-pressure part 4*a* of the steam turbine 4. In addition, a steam-inlet valve 42 is connected in the overflow line 22 and is arranged on the inlet side upstream of the steam-collecting space 44 designed as a casing of the turbine of the intermediate- and low-pressure part 4*b* of the steam turbine 4. The steam-inlet valves 38, 42 are more or less of identical construction and can be controlled by means of an electrical actuating signal to which a high-frequency disturbance signal is applied. For this purpose, the steam-inlet valves 38, 42 are each connected to a control unit 50 via control lines 46 and 48 respectively.

Figure 2:
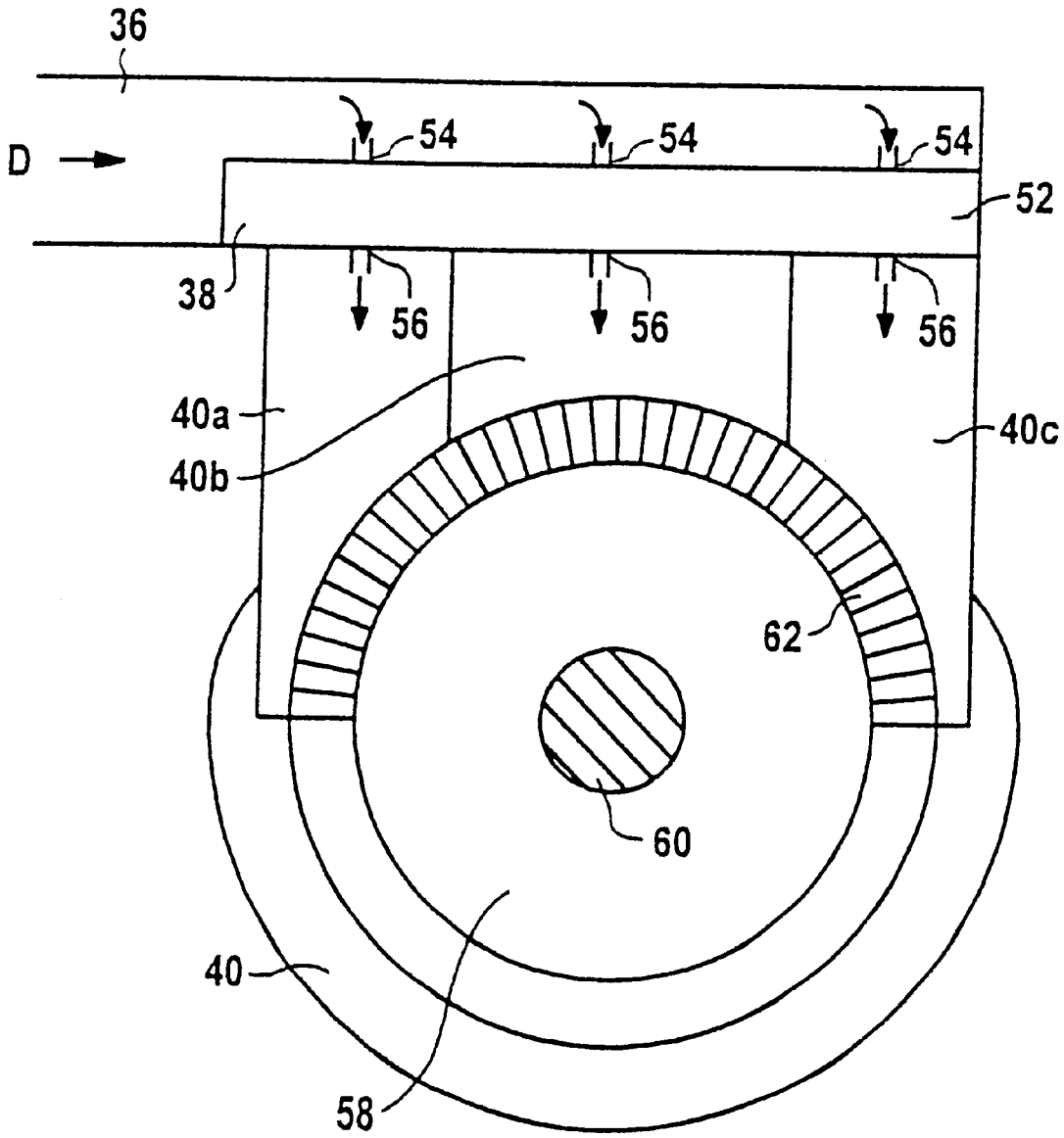
FIG. 2 is a schematic view of the configuration of a steam-inlet valve on the steam turbine according to FIG. 1.

Referring now to FIG. 2, the steam-inlet valve 38 is fastened directly to the steam-collecting space 40. Steam D passes from the steam line 36 into the steam-collecting space 40 via the steam-inlet valve 38. In its housing 52, the steam-inlet valve 38 has three steam inlets 54 and three steam outlets 56. The steam outlets 56 of the steam-inlet valve 38 open in each case into a chamber 40*a,* 40*b,* or 40*c,* respectively, of the steamcollecting space 40. A turbine 58, which comprises a rotor 60 and a number of turbine blades 62, is arranged in the steam-collecting space 40 of the high-pressure stage 4*a* of the steam turbine 4. The steam-inlet valve 42 is arranged in roughly the same manner on the steam-collecting space 44 configured as the casing of the turbine of the intermediate- and low-pressure part 4*b* of the steam turbine 4.

Figure 3:
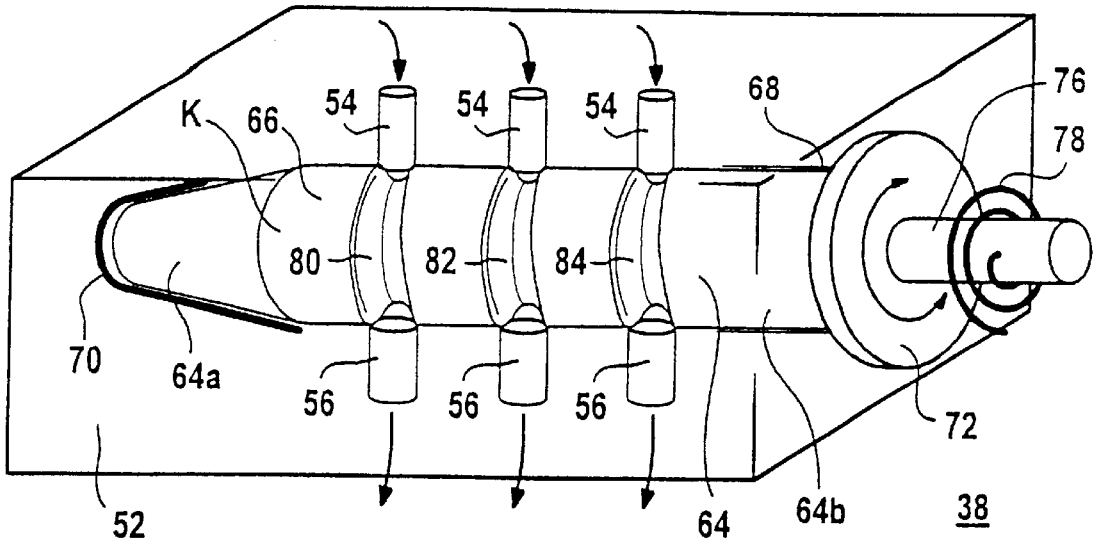
FIG. 3 is a perspective diagrammatic view of a steam-inlet valve according to FIGS. 1 and 2.
Figure 4:
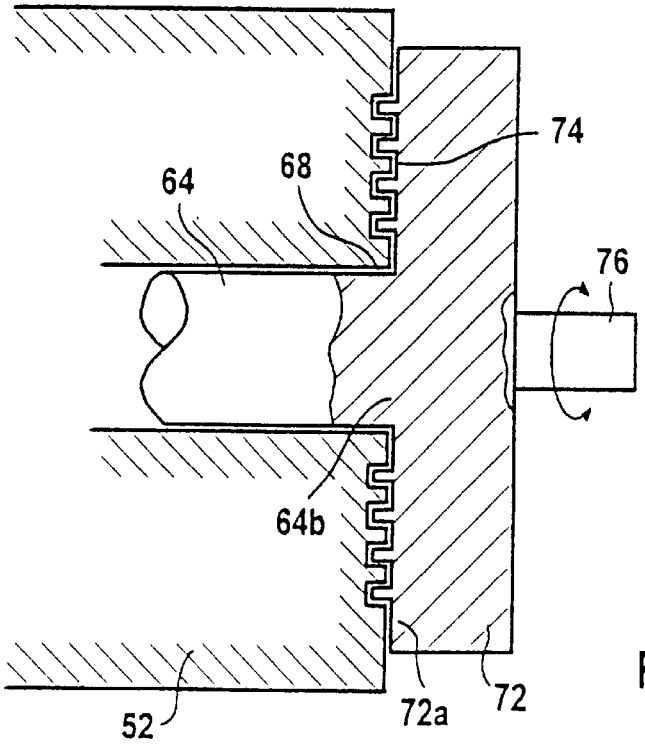
FIG. 4 is a partial section of the configuration of the end plate on the housing of one of the steam-inlet valves according to FIGS. 1 to 3.

Referring now to FIG. 3, there is shown, as an example of the steam-inlet valves 38, 42 of more or less identical construction, the steam-inlet valve 38 according to FIGS. 1 and 2. The steam-inlet valve 38 comprises a housing 52. Three steam inlets 54 and three steam outlets 56 are arranged in the housing 52. The housing 52 is made in one piece. A rotary cylinder 64 is disposed in the housing 52. A surface 66 of the cylinder 64 has a crenellated profile. It is made of a ceramic material K. The rotary cylinder 64 can be placed into the housing 52 via an access opening 68. With its end 64*a* arranged inside the housing 52, the rotary cylinder 64 is mounted in a conical bearing element 70 inside the housing 52. An end plate 72 is arranged on that end 64b of the rotary cylinder 64 which is not mounted in the housing 52. With reference to the detail in FIG. 4, the end plate 72 has a crenellated profile 74 on the side 72*a* facing the housing 52. A guide 76 is arranged on the end plate 72 of the rotary cylinder 64. Via the guide 76, the rotary cylinder 64 can be reset mechanically by a spring system 78.

Figure 5:
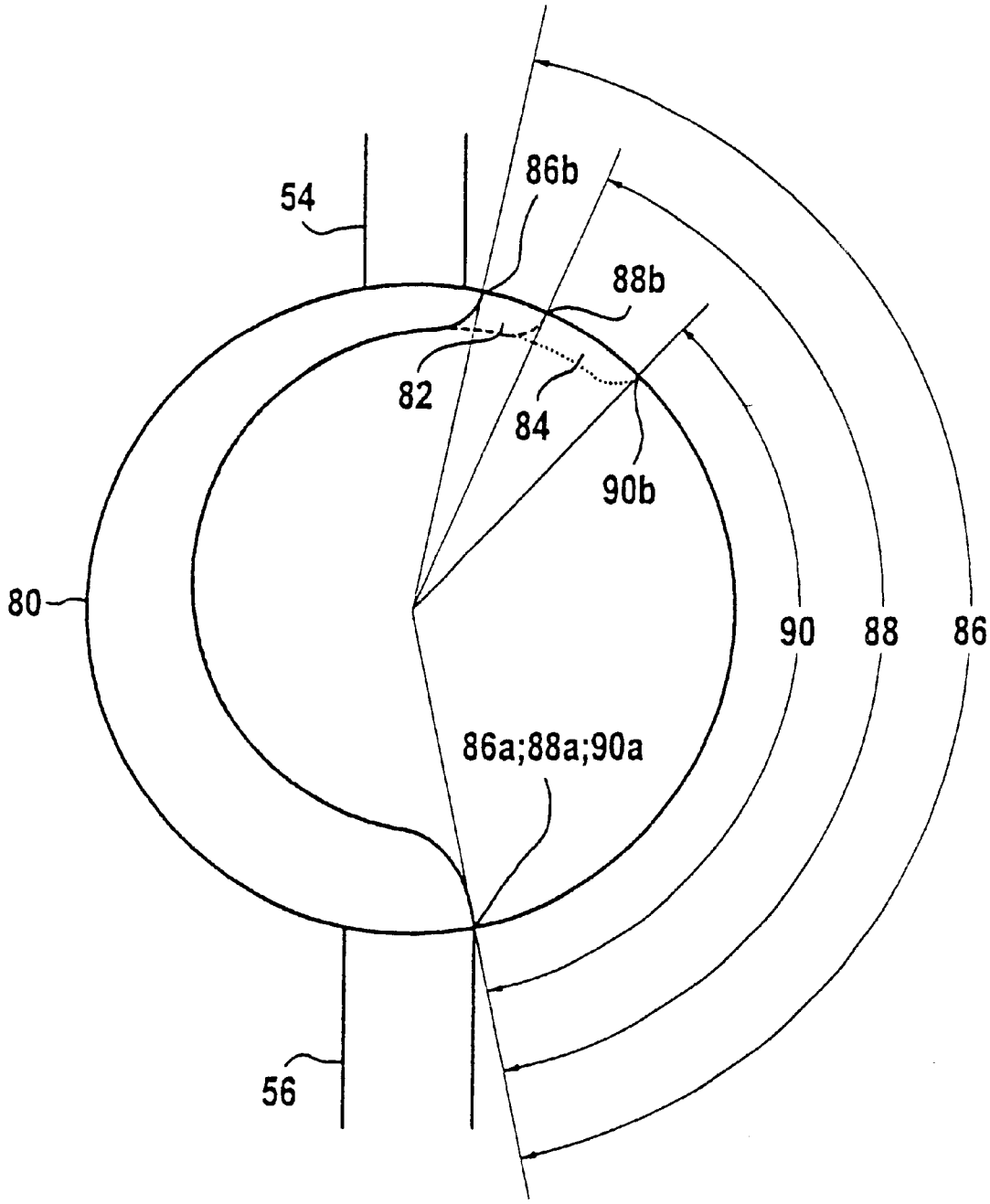
FIG. 5 is a schematic view illustrating the arc angles of the passages arranged on the surface of the rotary cylinder according to FIG. 3.

In its surface 66, the rotary cylinder 64 has three passages 80, 82 and 84, via which the steam inlets 54 can be connected to the steam outlets 56 assigned to them in each case. In this arrangement, the cross section of the passages 80, 82 and 84 in each case narrows along the steam path in a manner not shown in any more detail. In addition, the passages 80, 82 and 84, as shown in detail in FIG. 5, each have different arc angles 86, 88 and 90 respectively, which are each defined via a starting point 86*a,* 88*a,* 90*a* and an end point 86*b,* 88*b,* 90*b*. The arc angles 86, 88, 90 are selected in such a way that they are each greater than 180°. In this case, steam D can flow through the passage 80 in a first position of the rotary cylinder 64, steam D can flow through the passage 80 and the passage 82 in a second position of the rotary cylinder 64, and steam D can flow through the passage 80, the passage 82 and the passage 84 in a third position of the rotary cylinder 64.

An especially finely graduated control of the introduction of steam D into the respective steam-collecting spaces 40 and 44 of the steam-turbine plant is ensured by the especially high control performance of the steam-inlet valves 38, 42. At the same time, on account of the fact that the rotary cylinder 64 is configured as a shut-off member, the risk of the loss of steam D is kept especially low.

I claim:

1. A steam-turbine plant, comprising:

a steam turbine;

a steam-collecting space with an inlet side upstream of said steam turbine;

a steam-inlet valve disposed to control a flow of steam into said steam-collecting space at said inlet side;

said steam-inlet valve having a housing formed with a steam inlet and a steam outlet, and a rotary cylinder disposed in said housing and forming a shut-off member, said rotary cylinder being formed with a passage enabling a connection between said steam inlet and said steam outlet.

2. The steam-turbine plant according to claim 1, wherein said rotary cylinder has a peripheral surface and said passage of said steam-inlet valve extends along said peripheral surface of said rotary cylinder.

3. The steam-turbine plant according to claim 1, wherein said housing of said steam-inlet valve is a one-piece housing formed with a single access opening into which said rotary cylinder is inserted into said housing, and wherein an end plate disposed on a free end of said rotary cylinder seals off an interior space of said housing towards outside.

4. The steam-turbine plant according to claim 3, wherein said end plate is formed with a crenellated profile on a side thereof facing said housing.

5. The steam-turbine plant according to claim 3, which comprises a conical bearing element disposed inside said housing for mounting an end of said rotary cylinder inside said housing.

6. The steam-turbine plant according to claim 1, which comprises a spring system mechanically preloading said rotary cylinder of said steam-inlet valve.

7. The steam-turbine plant according to claim 1, wherein a surface of said rotary cylinder of said steam-inlet valve is made of a ceramic material.

8. The steam-turbine plant according to claim 1, wherein said steam-inlet valve is configured to be controlled with an actuating signal carrying a permanent disturbance signal.

9. The steam-turbine plant according to claim 2, wherein said passage has a narrowing cross section on rotation in a given direction.

10. The steam-turbine plant according to claim 1, wherein said passage is one of a plurality of passages formed on a surface of said rotary cylinder, and a respective said steam inlet is connectable with a respective said steam outlet via one of said passages.

11. The steam-turbine plant according to claim 10, wherein said passages extend along a respective arc angle, defined between a starting point and an end point of said passage, greater than 180°.

12. The steam-turbine plant according to claim 11, wherein said arc angles of said passages of the steam-inlet valve are selected such that steam can flow substantially exclusively through a first one of said passages in a first position of said rotary cylinder and steam can flow through said first passage and a second one of said passages in a second position of said rotary cylinder.

13. The steam-turbine plant according to claim 1, wherein said passage extends along an arc angle, defined between a starting point and an end point of said passage, greater than 180°.

* * * * *